United States Patent [19]

Menhardt

[11] Patent Number: 4,998,008

[45] Date of Patent: Mar. 5, 1991

[54] HEATING ELEMENT

[76] Inventor: Walther Menhardt, Hackhofergasse 5, A-1190 Vienna, Austria

[21] Appl. No.: 426,309

[22] Filed: Oct. 24, 1989

[51] Int. Cl.[5] ..... H05B 3/18; H05B 3/14

[52] U.S. Cl. ..... 219/544; 219/505; 338/22 R

[58] Field of Search ..... 219/230, 505, 403, 407, 219/544, 504; 338/22 R

[56] References Cited

U.S. PATENT DOCUMENTS

| | | | |
|---|---|---|---|
| 4,371,778 | 2/1983 | Meixner et al. | 219/302 |
| 4,468,555 | 8/1984 | Adachi et al. | 219/237 |
| 4,493,972 | 1/1985 | Steinel et al. | 219/230 |
| 4,700,050 | 10/1987 | Hennuy et al. | 219/438 |

*Primary Examiner*—Roy N. Envall, Jr.
*Attorney, Agent, or Firm*—Collard, Roe & Galgano

[57] ABSTRACT

A self-regulating heating device with a lamellar resistance-heating body made of an electrically conducting ceramic material with a positive temperature coefficient which heating body, together with electrical insulating bodies through which heat is dissipated from the heating body, is squeezed via wedging into a wedge-shaped slot of a body or housing body to be heated. The lamellar resistance-heating body is wedge-shaped in construction and the essentially planar wedge surfaces of this heating body which extend obliquely toward each other, through interjoining of the insulating bodies, are facing the lateral surfaces of the slot. Preferably, thermal resistance is reduced at the heat exchanging contact surfaces by a thin contact layer made of thermal conducting mass. Current supply is effected at the surfaces of the resistance-heating body adjacent to the wedge surfaces.

12 Claims, 2 Drawing Sheets

HEATING ELEMENT

BACKGROUND OF THE INVENTION

1. Field of the Invention

The invention relates to a self-regulating heating device with a lamellar resistance-heating body made of an electrically conducting ceramic material with a positive temperature coefficient. More particularly, it relates to such a heating device which comprises a heating body that is wedged together with electrical insulating bodies into a wedge-shaped slot of a body to be heated. The heat generated in the heating body is dissipated through said insulating bodies.

2. The Prior Art

Self-regulating heating devices of the aforementioned type are known (German Patent Specification 28 16 076), in which the resistance-heating body made of electrically conducting ceramic material is configured as a plane parallel lamina. In order to achieve a wedging effect, which is intended to result in a proper contact of the heating device components associated with the dissipated of heat, a special wedge body is provided or the insulating bodies arranged at both sides of the resistance-heating body are themselves wedge-shaped in construction. This arrangement, in the former instance, requires at least one additional part, specifically, a special wedge body. It also increases the number of the transition surfaces lying in the thermodiffusion path, which fact results in an undesired increase in thermal resistance and which is detrimental to the heating devices of the aforementioned kind because it negatively affects self-regulating efficiency. With the second aforementioned configuration of the heating device known in the art, in which both insulating bodies arranged on both sides of the heating body are themselves wedge-shaped in construction, the use of two wedge bodies results in relatively high fabrication costs. Also the wedge shape of the insulating bodies additionally results in the fact that these insulating bodies exhibit varying thickness at various locations which produces substantial variations in thermal resistance, resulting in uneven dissipation of the heat generated in the heating body which can bring about local electrical overloads.

German Patent Specification 25 43 314 discloses a two-layered heating body in which both layers are wedge-shaped in construction and are laminated together to a plane parallel body. The one layer consists of PTC materaial, the other layer being of common resistance material; through this configuration the dissipation of thermal energy, viewed over the surface of the heating body, is intended to assume different values.

SUMMARY OF THE INVENTION

It is an object of the present invention to provide a self-regulating heating device of the aforementioned type which is relatively simple and straightforward in design and which eliminated the drawbacks mentioned hereinbefore.

The above object is accomplished in accordance with the present invention by providing a heating device of the aforementioned type which is characterized in that the lamellar resistance-heating body is wedge-shaped. The generally planar wedge surfaces of this heating body which extend obliquely toward each other, through interjoining of the insulating bodies, are disposed opposite and face the lateral surfaces of the slot which surfaces run approximately parallel to the wedge surfaces of the resistance-heating body such that the geometrical generatrices of the wedge surfaces of the resistance-heating body run in the longitudinal direction of the slot. The current supply is effected at the surfaces of the resistance-heating body located adjacent to the wedge surfaces. Preferably, a thin contact layer made of thermal conducting mass, reduces thermaal resistance at the heat exchanging contact surfaces which lie between the heating body and the insulating bodies and the body to be heated. By virtue of this configuration, the aforestated object can be suitably achieved. At low fabrication costs, intimate contact at the heat diffusion surfaces and, consequently, good thermal dissipation with low thermal resistance can be achieved, which, with respect to the temperature existing at the body or housing body to be heated, results in good regulating efficiency. Also the assembly of the heating device can be effected in a straightforward manner. The wedge-shaped configuration of the heating body, vis-a-vis the prior art configuration, results in a decrease in the number of component parts and better stability from the mechanical standpoint, a fact which is advantageous both for assembly and for thermal exchange behavior. By virtue of the wedge-like shape of the resistance-heating body, smaller fabrication tolerances for the thickness of the heating body, and for the width of the slot accommodating said body, have practically no disadvantageous effects on heat exchange from the heating body to the sides of the slot. The heating device also displays stable operating characteristics. The connection of the current supply to the narrow surfaces of the resistance-heating body, which lie adjacent to the wedge surfaces forming the wedge, results in a more uniform distribution of current flow, whereby self-regulation is improved.

In addition, the present invention is directed to a self-regulating heating device comprising a lamellar resistance-heating body made of an electrically conducting ceramic material with a positive temperature coefficient which is wedge-shaped and having essentially planar wedge surfaces which surfaces extend obliquely toward each other; interjoined electrical insulating bodies through which heat is dissipated from the heating body; a housing to be heated having a wedge-shaped slot having lateral surfaces, said heating body surfaces are being disposed opposite to and facing the lateral surfaces of the slot which surfaces run approximately parallel to the wedge surfaces of the resistance-heating body, such that the geometrical generatrices of the wedge surfaces of the resistance-heating body run in the longitudinal direction of the slot; and means for supplying current at the surfaces of the resistance-heating body located next to the wedge surfaces forming the wedge.

An advantageous practical embodiment which, following a simple assembly operation, enables relatively high contact pressure to be achieved without the risk of a pressure overload and which also provides automatic equalization of thermal expansion during operation has a spring operating in the wedge direction which presses the resistance-heating body in the wedge direction into the slot provided to receive it.

With respect to current supply, in many instances it is expedient, due to design considerations, if current supply is effected at the narrow sides of the resistance-heating body extending in the longitudinal direction of the slot. This, despite the constant change in the thickness of the lamellar or plate-like heating body in the course of the flow of current through the heating body, results in uniform heating of said body, a fact which can be explained in that current flow, by virtue of the resistance characteristics of the heating body, is greater in the surface areas than internally. According to another practical embodiment, current supply is effected at the narrow sides of the resistance-heating body extending along the wedge surfaces in the wedge direction. The terminals can be soldered to the resistance-heating body or maintained in contact through pressure. A structurally straightforward design is achieved if pressure springs are themselves used as terminals; an elongated spring made of corrugated wire, for example, is well suited for this purpose and is inserted or wedged in between the heating body and an insulation which crosses the slot.

A particularly advantageous embodiment with respect to assembly and operating characteristics has lamellar insulating bodies made of a compactly sintered or melted, suitably heat-conducting inorganic material which rest against both wedge surfaces of the resistance-heating body, which insulating bodies, in turn, rest against the lateral surfaces of the slot.

Particularly good security of the electrical insulation, with concurrent low thermal resistance and straightforward design is provided by an embodiment which has the insulation bodies being multilayered and in that, in said configuration, one layer is formed from a compactly sintered or melted, suitably heat-conducting inorganic material and in that at least one layer is formed from an electrically insulating foil. A variation of this embodiment has the insulation bodies being multilayered in construction and in said configuration one layer is formed from a compactly sintered or melted, suitably heat-conducting inorganic material and at least one layer from heat-conducting mass which has hardened in situ. Other variations are also possible. Accordingly, multilayered insulation bodies can be formed, for example, from two superposed lamellas made from a compactly sintered or melted, suitably heat-conducting inorganic material. In liew of a foil, an inorganic, insulating layer can be provided which, for example, is applied to the lamellas made of inorganic material which form the insulation bodies; said layers may consist, for example, of $SiO_2$ or other oxides or be composed of nitrides. Foils filled with $Al_2O_3$ may also be used. In the configuration comprising multilayered insulation bodies, the mechanically stable wedging effect which can be achieved through the design of the heating device according to the invention reveals itself to be particularly advantageous with respect to ease of assembly and with regard to compression to low thermal contact resistance.

BRIEF DESCRIPTION OF THE DRAWINGS

Other objects and features of the present invention will become apparent from the following detailed description considered in connection with the accompanying drawing which discloses a few embodiments of the present invention. It should be understood, however, that the drawing is designed for the purpose of illustration only and not as a definition of the limits of the invention.

In the drawing wherein similar reference characters denote similar elements throughout the several views.

DETAILED DESCRIPTION OF THE PREFERRED EMBODIMENTS

Figure 1:
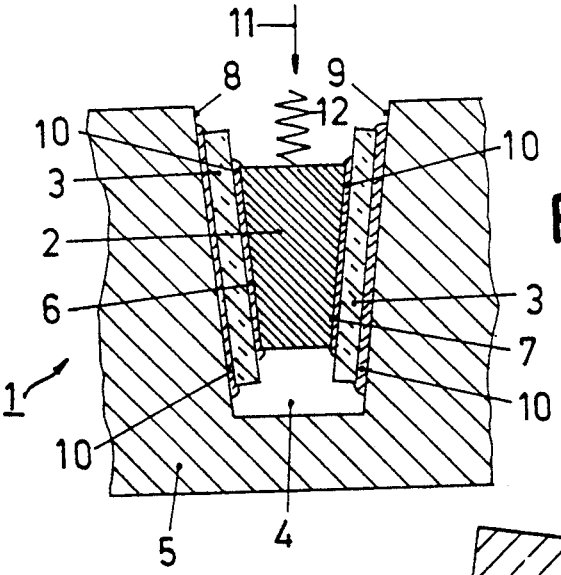
FIG. 1 is a cross-sectional view of a first embodiment of a heating device according to the invention.

Turning now in detail to the drawings, a first embodiment of a self-regulating heating device 1 is shown in a cross-sectional view in FIG. 1. Heating device 1 includes a plate-like or lamellar resistance-heating body 2 made of electrically conducting ceramic material with a positive temperature coefficient. The heating body 2, together with electrical insulating bodies 3, through which heat is dissipated from the heating body 2, is wedged into a slot 4 of a body 5 to be heatted. The body 5 can, for example, form a housing of the heating device 1 which dissipates heat to other bodies or itself constitute the locus of thermal requirements. In order to achieve the wedging effect, the lamellar resistance-heating body 2 is wedge-shaped in construction. The body 2 has oppositely disposed generally planar wedge surfaces 6, 7 which extend obliquely toward each other, and via interposed insulating bodies 3, are disposed opposite and face the lateral surfaces 8, 9 of the slot 4. In order to reduce thermal resistance at the heat exchanging contact surfaces which lie between the heating body 2, the insulating bodies 3 and the body 5 to be heated, a thin contact layer 10 made of a heat-conducting mass is preferably provided at these abutting surfaces between said aforementioned bodies.

The insulation bodies 3 expediently consist of a compactly sintered or melted, suitably heat-conducting inorganic material, such as $Al_2O_3$, for example. If desired, these insulation bodies may also be multilayered. Electrically insulating heat proof foils, like, for example, a polyimide foil, can also be used as insulating bodies, in which case, if required, several such foils can be superposed. In this instance, too, thermal resistance at the heat-exchanging contact surfaces will preferably be reduced by a heat-conducting mass. Insulation bodies can also be made from different materails, such as, for example, sintered $Al_2O_3$ and insulating foils. In order to achieve the desired contact pressure between the wedge surfaces 6, 7 of the heating body 2 and the insulation bodies 3 and the lateral surfaces 8, 9 of the slot 4, the heating body 2 is pressed into the slot 4 in the direction of the wedge which is indicated here by the arrow 11. To this end, a spring 12, for example, can be provided or the wedge-shaped heating body 2 can be pressed into the slot 4 and maintained fixed therein. This effect can be achieved by means of suitable packing materials, which prevent backward slippage of the heating body 2 in the direction of the arrow 11. Alternatively, this can be effected by appropriate dimensioning of the wedge angle in such a way that the heating body 2 is secured by means of friction and there is an automatic locking in its pushed-in position in the slot 4.

Current supply to the heating body 2 is effected by connecting electrical terminals to opposing points which are situated at the narrow sides of the heating body lying next to the wedge surfaces. A pressure spring 12 can also be used as a connecting terminal.

Figure 2:
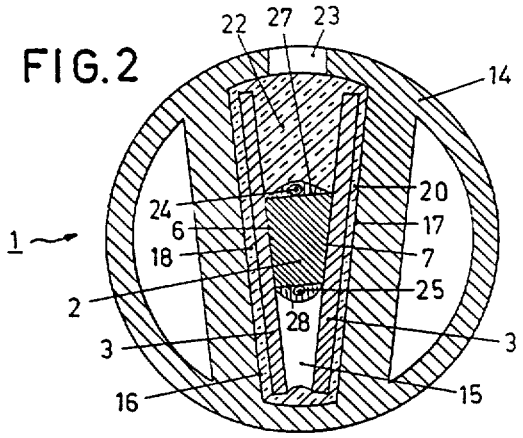
FIG. 2 is a cross-sectional view of a second embodiment.

In a second embodiment shown in FIG. 2, the body to be heated is formed by a metal section 14 which, viewed circumferentially, is essentially closed and, in its interior, exhibits a slot-like hollow space 15. A wedge-shaped resistance-heating body 2 is arranged within metal body 14. Heating body 2 consists of an electrically conducting ceramic material with a positive temperature coefficient and is flanked by two insulation bodies 3 consisting of a suitably heat-conducting inorganic material. Layers 18, 20 of a suitably heat-conducting, electrically insulating mass, such as, for example, a silicon mass hardened in situ and containing a high content of inorganic filler, are arranged between the insulation bodies 3 and the lateral sided 16, 17 of the slot 15 which extend approximately parallel to the wedge surfaces 6, 7 of the heating body 2. This mass also forms a locking or retaining plug or body 22 which protects the heating body 2 and the insulation bodies 3 from backward slippage in the direction of the arrow 11 (FIG. 1) and, in so doing, sustains adequate contact pressure at the heat diffusion surfaces from the heating body 2 to the metal section 14. Such materials, as a rule, exhibit a significantly higher expansion coefficient than metals, such that the heating up of the heating device which also occurs during operation does not diminish the contact pressure at the aforestated surfaces nor, consequently, does it diminish heat exchange.

To assemble the heating device shown in FIG. 2, the heating body 2 and insulation bodies 3 can be inserted axially into the slot-shaped hollow space 15 and the heat-conducting material intended to form the layers 18, 20 and the body 22 injected. The operation required to do this can be facilitated if, in the area in which the heating body 2 is to be placed, an opening 23 is provided leading through the wall of the metal section 14. The opening 23 facilitates manipulation of the heating body 2 during positioning and the applying of pressure and through said opening heat-conducting mass can be placed inside the hollow space 15.

Connecting terminals 24, 25, providing current supply to the heating body 2, are connected at the narrow sidese 27, 28 of said heating body which sides extend along the wedge surfaces 6, 7 of the heating body 2. These narrow sides 27, 28 extend in the longitudinal direction of the slot-shaped hollow space 15.

Figure 3:
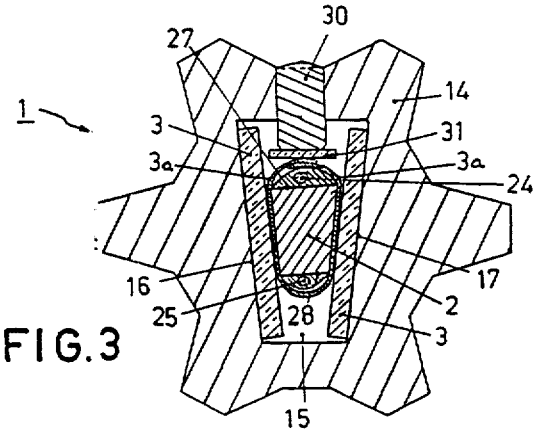
FIG. 3 is a cross-sectional view of a third embodiment.
Figure 6:
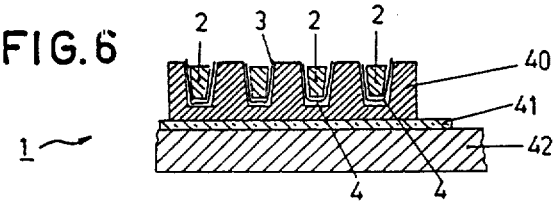

In the third embodiment according to FIG. 3, similar to the embodiment according to FIG. 2, the body to be heated by the heating body 2, is configured in the form of a metal section 14. The electrical insulation between the heating body 2 and the lateral surfaces 16, 17 of the slot-shaped hollow space 15 provided for in the metal section 14 is constituted by lamellar insulation bodies 3 made of compactly sintered or melted, suitable heat-conducting inorganic material and by an electrically insulating foil **3*a* which is heat proof. The foil 3*a*, in the configuration shown, is wrapped around the heating body 2; if needed, several foil turns can be provided. However, foil lamellas, each of which rests against a side of the heating body, can be used instead of the wrapping. The foil 3*a*, together with each of the lamellar insulation bodies 3, forms a multilayered insulation. In FIG. 3, in order to reduce thermal resistance at the heat diffusion surfaces, a thin contact layer made of a heat-conducting mass can be advantageously provided. Such provision is not indicated in greater detail in FIG. 3. Current supply to the heating body 2 is effected, via electrical terminals 24, 25 which make contact with the narrow sides 27, 28 of the heating body 2 which extend in the longitudinal direction of the slot-shaped hollow space 15**.

In order to push the heating body 2 in the direction of the wedge indicated in FIG. 1 by arrow 11, a screw 30 is provided. This screw presses in the direction of the arrow 11 causing interjoining of the overlapped electrical insulation 31 on the heating body 2. If desired, a spring, for example, a coil spring or a leaf spring, or a spring made of corrugated wire, can be provided between the screw 30 and the insulation 31 or between the insulation 31 and the heating body 2.

Figure 4:
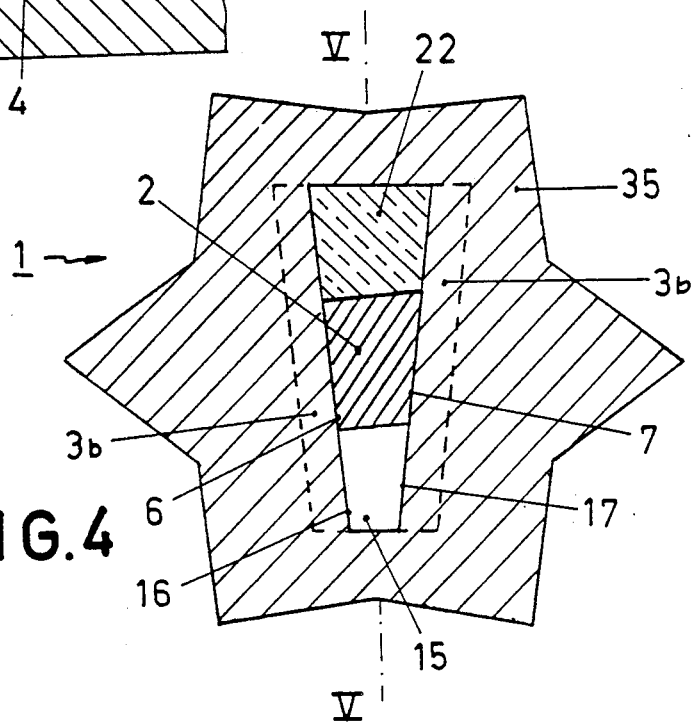
FIG. 4 is a cross-sectional view of a fourth embodiment in which the body displaying the slot is integrated with the insulation bodies.
Figure 5:
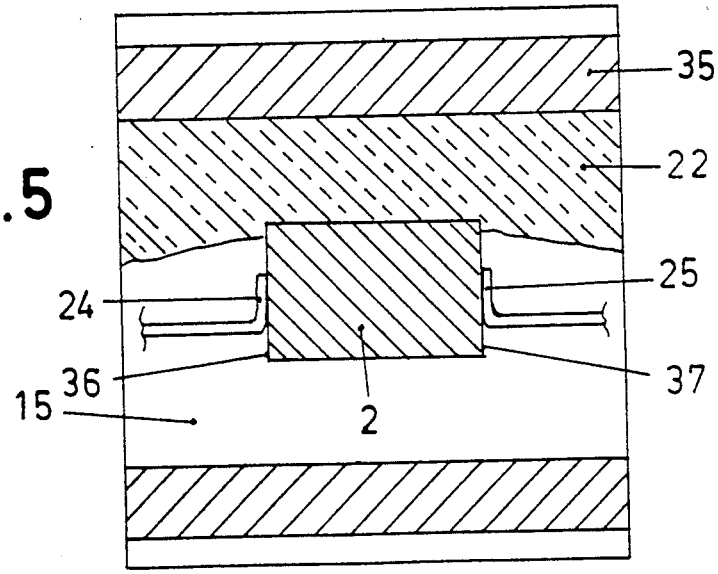
FIG. 5 is a longitudinal sectional view of the embodiment of FIG. 4.

In a fourth embodiment according to FIGS. 4 and 5, the heating body 2 is arranged in the slot-like hollow space 15 of a sectional body 35 made of a heat-conducting, electrically insulating ceramic material. Body 35 constitutes the body to be heated by the heating body 2 and at the same time, integrates the insulation bodies **3*b* forming zones therein as indicated by the dotted-dashed lines. The lateral surfaces 16, 17 of the slot-shaped hollow space 15 extend, like the lateral surfaces 6, 7, of the heating body 2 in a wedge-like manner. To ensure tight abutment of the heating body 2 on the lateral surfaces 16, 17 of the slot-shaped hollow space, a retaining body 22, made of a heat-conducting mass hardened in situ, is provided. Current flow occurs in this embodiment in the longitudinal direction of the heating body 2 and, to this end, electrical terminals 24, 25 are connected to the narrow sides 36, 37 of the heating body 2. In place of the retaining body 22**, an elongated spring made of corrugated wire, can also be provided. This spring can also function as a means to supply current to the heating body.

Figure 6:
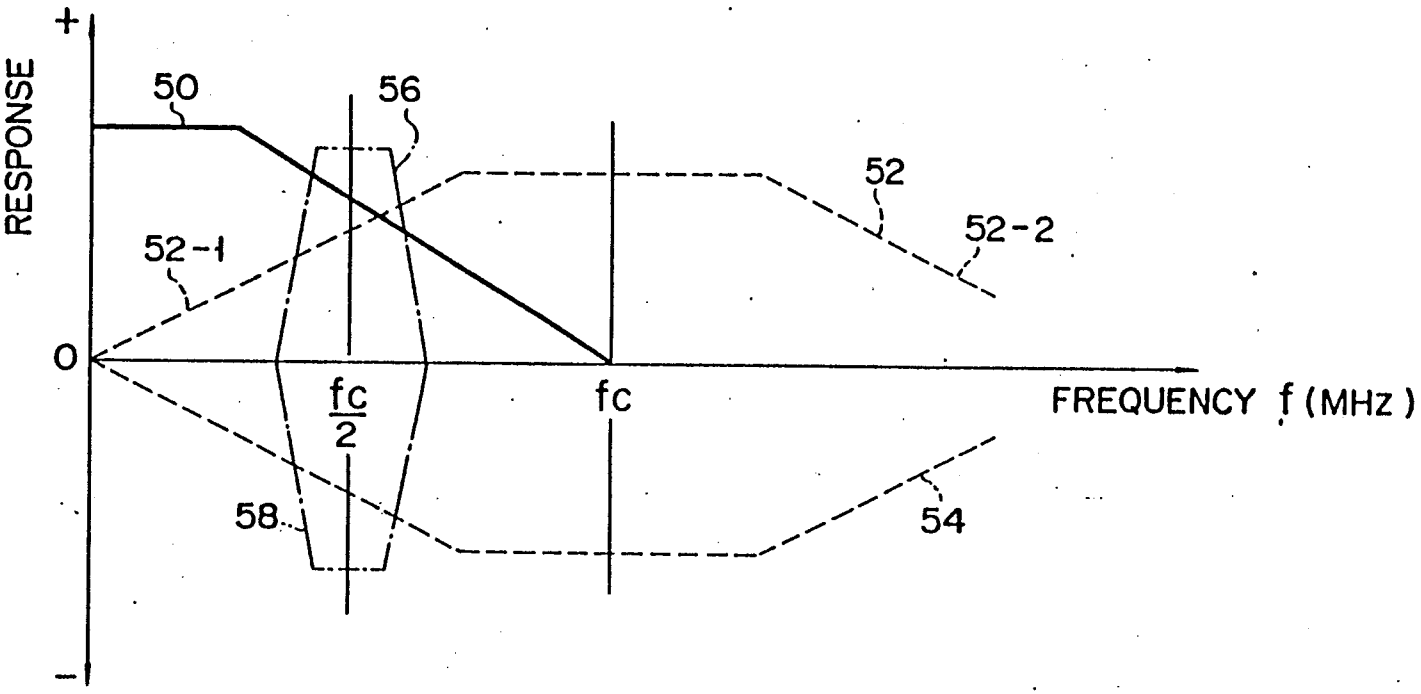
FIG. 6 is a cross-sectional view of a further embodiment in which several resistance-heating bodies are provided.

In the embodiment shown in FIG. 6, several wedge-shaped heating bodies 2, which are made of an electrically conducting ceramic material with a positive temperature coefficient, are provided. Each of these heating bodies is wedged into a slot 4 of a metal body 40 provided with a series of such slots. For electrical insulation purposes, insulation bodies in the form of electrically insulating heat proof foils have been fitted in between the heating bodies 2 and the lateral walls of the slots 4. To ensure contact pressure, springs or locking or retaining bodies are provided (not shown) or dimensioning is executed in such a way that a self-blocking friction locking results. As previously discussed, a contact layer made of a heat-conducting mass (not shown) can be provided at the contact surfaces over which heat exchange from the heating bodies 2 to the metal body 40 is effected. The metal body 40, via interposed electrical insulation 41, presses against a metal body 42. The insulation 41 can desirably be made of a compactly sintered or melted, suitably heat-conducting inorganic material and/or one or several electrically insulating foils. In this instance, too, a contact layer made of a heat-conducting mass can be provided to reduce the thermal resistance at the contact surfaces at which heat exchange occurs.

While only a few embodiments of the present invention have been shown and described, it is to be understood that many changes and modifications may be made thereunto withou departing from the spirit and scope of the invention.

What is claimed is:

1. A self-regulating heating device comprising:

a heatable housing having lateral surfaces defining a wedge-shaped slot;

a wedge-shaped lamellar resistance-body made of an electrically conducting ceramic material with a positive temperature coefficient, said wedge-shaped body having generally planar wedge surfaces and narrow sides, which wedge surfaces extend obliquely toward each other in the wedge direction, and said wedge-shaped resistance heating body being wedged in said wedge-shaped slot of said housing, said wedge surfaces are disposed opposite and parallel to said lateral surfaces of said housing with the geometrical generatrices of the wedge surfaces of the resistance heating body running in the longitudinal direction of said slot;

electrical insulating bodies disposed intermediate said wedge surfaces and said lateral surfaces for dissipating heat from said heating body;

means for supplying electric current to opposing narrow sides of said resistance heating body; and said wedge surfaces of the heating body, the surfaces of the insulating bodies being in contact with said wedge surfaces and the surfaces of the insulating bodies being in contact with the lateral surfaces of the housing and the lateral surfaces of the housing are acting as heat exchanging contact surfaces.

2. The heating device according to claim 1, wherein said means for supplying current are connected to the narrow sides of the resistance-heating body

3. The heating device according to claim 1, wherein said means for supplying current are connected to the narrow sides of the resistance-heating body extending in the longitudinal direction of the slot.

4. The heating device according to claim 1, further comprising a thin contact layer made of thermal conducting mass for reducing the thermal resistance at the heat exchanging contact surfaces which lie between the heating body, and the insulating bodies and the housing to be heated.

5. The heating device according to claim 1, wherein the insulating bodies have a lamellar shape and are made of a compactly sintered or melted, suitably heat-conducting inorganic material which rest against both wedge surfaces of the resistance-heating body, which insulating bodies, in turn, rest against the lateral surfaces of the slot.

6. The heating device according to claim 1, wherein the insulating bodies are formed by insulating foils.

7. The heating device according to claim 1, wherein the insulating bodies are multilayered and have one layer of said multilayers being formed from a compactly sintered or melted, suitably heat-conducting inorganic material and have at least one other layer of said multilayers being formed from an electrically insulating foil.

8. The heating device according to claim 1, wherein the insulating bodies are multilayered and have one layer of said multilayers being formed from a compactly sintered or melted, suitably heat-conducting inorganic material and have at least one other layer of said multilayers being formed from heat-conducting mass which has hardened in situ.

9. The heating device according to claim 1, wherein said housing contains at least one slot with a resistance-heating body inserted into said slot;

said housing being made of metal; and being pressed to a further metal body which is to be heated; and which is electrically insulated from said housing by insulating bodies consisting of a compactly sintered or melted, suitably heat-conducting inorganic material, disposed intermediate said housing and said further metal body.

10. The heating device according to claim 1, wherein said housing contains at least one slot with a resistance-heating body inserted into said slot;

said housing being made of metal; and being pressed to a further metal body which is to be heated; and which is electrically insulated from said housing by insulating bodies consisting of at least one electrically insulating foil disposed intermediate said housing and said further metal body.

11. The heating device according to claim 1, wherein the insulating bodies arranged at both sides of the lamellar resistance-heating body are part of a body made of a heat-conducting insulating ceramic material and including said wedge-shaped slot.

12. The heating device according to claim 1, wherein a spring operating in the wedge direction is provided which presses the resistance-heating body in the wedge direction into the slot provided to receive it.

* * * * *

UNITED STATES PATENT AND TRADEMARK OFFICE

CERTIFICATE OF CORRECTION

PATENT NO. : 4,998,008

DATED : March 5, 1991

INVENTOR(S) : Walther Menhardt

It is certified that error appears in the above-identified patent and that said Letters Patent is hereby corrected as shown below:

Please delete drawing FIG. 6 from the issued patent and substitute therefor FIGS. 2, 3 and 6, as set forth in the attached drawing sheet.

Signed and Sealed this

Seventh Day of July, 1992

*Attest:*

DOUGLAS B. COMER

*Attesting Officer*

*Acting Commissioner of Patents and Trademarks*